US011754297B2

(12) United States Patent
Hackert et al.

(10) Patent No.: US 11,754,297 B2
(45) Date of Patent: Sep. 12, 2023

(54) BASE STATION FOR CONNECTING A CLEANING DEVICE AND METHOD FOR OPERATING A CLEANING SYSTEM

(71) Applicant: Vorwerk & Co. Interholding GmbH, Wuppertal (DE)

(72) Inventors: Georg Hackert, Bochum (DE); Uwe Kemker, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 295 days.

(21) Appl. No.: 16/922,361

(22) Filed: Jul. 7, 2020

(65) Prior Publication Data

US 2021/0010685 A1 Jan. 14, 2021

(30) Foreign Application Priority Data

Jul. 11, 2019 (EP) ..... 19185783

(51) Int. Cl.

| | |
|---|---|
| ***F24F 1/005*** | (2019.01) |
| ***A47L 9/10*** | (2006.01) |
| ***A47L 9/14*** | (2006.01) |
| ***A47L 9/28*** | (2006.01) |
| ***F24F 13/20*** | (2006.01) |

(52) U.S. Cl.

CPC ..... *F24F 1/005* (2019.02); *A47L 9/106* (2013.01); *A47L 9/149* (2013.01); *A47L 9/2873* (2013.01); *F24F 13/20* (2013.01)

(58) Field of Classification Search

None

See application file for complete search history.

(56) References Cited

U.S. PATENT DOCUMENTS

| | | | | |
|---|---|---|---|---|
| 5,481,780 | A | 1/1996 | Daneshvar | |
| 9,931,007 | B2 | 4/2018 | Morin et al. | |
| 2016/0183752 | A1* | 6/2016 | Morin | A47L 9/009 15/340.1 |
| 2017/0203446 | A1* | 7/2017 | Dooley | H04N 23/63 |
| 2019/0011413 | A1* | 1/2019 | Caussy | G05D 1/0225 |

FOREIGN PATENT DOCUMENTS

| | | | | |
|---|---|---|---|---|
| CN | 101596390 | A | 12/2009 | |
| CN | 206560406 | U | 10/2017 | |
| CN | 107405031 | A | 11/2017 | |
| DE | 202016104067 | U1 | 10/2017 | |
| DE | 202016104067 | U1 * | 12/2017 | A47L 11/40 |
| EP | 3033982 | A1 | 6/2016 | |

OTHER PUBLICATIONS

English Machine Translation of DE-202016104067-U1 provided by applicant.*

* cited by examiner

*Primary Examiner* — Mikhail Kornakov
*Assistant Examiner* — Pradhuman Parihar
(74) *Attorney, Agent, or Firm* — Jason H. Vick; Sheridan Ross, PC

(57) ABSTRACT

A base station for connecting a cleaning device and a method for operating a cleaning system with a cleaning device and such a base station are proposed, wherein the room air is conditioned by means of the base station and/or the quality of the room air is measured by means of the base station.

11 Claims, 3 Drawing Sheets

BASE STATION FOR CONNECTING A CLEANING DEVICE AND METHOD FOR OPERATING A CLEANING SYSTEM

CROSS-REFERENCE TO RELATED APPLICATIONS

This application claims the benefit under 35 U.S.C. 119(a) to European Patent Application No. 19 185 783.8, filed Jul. 11, 2019, the disclosure of which is incorporated herein by reference in its entirety.

FIELD

The present invention relates to a base station for electrically and/or fluidically connecting a cleaning device and a method for operating a cleaning system.

A base station in the sense of the present invention is a structural, preferably stationary, device for connecting and/or servicing/maintaining a (mobile) cleaning device, such as a vacuum cleaner, in particular for sucking out or emptying and/or electrically charging the cleaning device.

A base station within the sense of the present invention has for this purpose a fluidic/pneumatic and/or electrical connection for the cleaning device.

DESCRIPTION OF RELATED ART

European Patent Application EP 3 033 982 A1 discloses a base station for a hand vacuum cleaner, wherein the base station can be connected to an optional adapter module in order to connect a cleaning robot to the base station in addition to the hand vacuum cleaner.

SUMMARY

Object of the present invention is to provide an improved base station and an improved method for operating a cleaning system with a base station and a cleaning device.

The problem underlying the invention is solved by a base station or a method for operating a cleaning system as disclosed herein.

A cleaning system in the sense of the present invention is a system with a plurality of components for cleaning surfaces, in particular floors. Such a cleaning system comprises at least one, preferably a plurality of (mobile) cleaning devices, such as a vacuum cleaner, and a preferably stationary base station for maintenance, in particular for emptying and/or electrical charging, of the cleaning device(s).

A cleaning device in the sense of the present invention is preferably a vacuum cleaner, for example a hand-held vacuum cleaner, an in particular movable floor vacuum cleaner, a vacuum cleaner with snout, a rod/stick vacuum cleaner or a (partially) autonomous or self-driving or self-flying robotic vacuum cleaner.

However, a cleaning device within the sense of the present invention may also be any other device for cleaning and/or maintaining surfaces, in particular floors. For example, floor wiping devices or robots, polishing devices or robots, window cleaning devices or robots, or lawn mowing devices or robots are also to be understood as cleaning device within the sense of the present invention.

The cleaning device can be connected to the base station after use or after a cleaning process in order to maintain, in particular to electrically charge and/or to empty or suck out, the cleaning device, preferably automatically or in a self-acting manner.

The expression "sucking out" a cleaning device or a chamber thereof preferably is to be understood as removing or withdrawing material contained in the cleaning device by suction. In other words, material is sucked off or drawn out of the cleaning device, or the cleaning device is emptied or evacuated. The corresponding process is referred to as "suction process" in the following. Consequently, the base station and/or cleaning device are in "suction mode" during a suction process.

The material contained in the cleaning device is in particular vacuumed material, such as dust, which was received by the cleaning device in a cleaning process, for example when vacuuming the floor with the cleaning device. During a cleaning process, the cleaning device is in "cleaning mode".

The operation of cleaning devices and/or base stations can stir up dust and/or generate heat and thus change or worsen the quality of the ambient air or room air.

According to one aspect of the present invention, the base station has a an in particular integrated air conditioner/climate control device for conditioning and/or climatization of the ambient air or room air, preferably wherein the climate control device is designed for cleaning/filtrating, humidifying, dehumidifying, warming/heating and/or cooling the ambient air or room air.

By means of the climate control device it is possible to condition/climatize, in particular to clean, humidify, dehumidify, heat and/or cool, the ambient air or room air, for example before, during and/or after a cleaning process, a use of the cleaning device and/or a maintenance process, in particular a suction process, by means of the base station.

In particular, by means of the proposed base station, the quality of the room air can be improved during and/or after a cleaning process and/or a maintenance process, and/or the negative influence on room air quality caused by the operation of the cleaning device and/or base station can be at least partially compensated.

According to a further aspect of the present invention, which can also be realized independently, the base station has an in particular integrated measuring device to measure or determine the quality of the room air, in particular the number, size and/or concentration of (dust) particles in the room air, the temperature and/or the humidity of the room air.

By means of the measuring device it possible to control the climate control device and, in particular, to start or stop and/or adapt/adjust the conditioning/climatization based on the measured values registered by the measuring device.

For example, the measuring device can have one or more sensors, in particular dust, temperature and/or humidity sensors.

The term "air quality" or "room air quality" in the sense of the present invention is preferably understood to mean the concentration, density, size and/or number of impurities or particles, such as dust particles, contained in the (ambient) air or room air and/or the temperature of the (ambient) air or room air and/or the humidity or moisture content of the (ambient) air or room air.

The base station preferably has a container for vacuumed material of the cleaning device. In particular, vacuumed material from the cleaning device can be collected and/or separated in the container when the cleaning device is connected to the base station and/or sucked out by the base station. The base station is optionally equipped with a filter, in particular a filter bag, which is arranged in the container.

According to a particularly preferred embodiment, the container of the base station is, in particular pneumatically, connected or connectable to the climate control device, in particular in such a way that the room air conducted through the container can (subsequently) be aftertreated/post-treated by means of the climate control device, in particular cleaned, humidified, dehumidified, heated and/or cooled and/or is in the conditioned state (again) released to the environment/surroundings.

The term "air conditioner" or "climate control device" in the sense of the present invention is to be understood as a structural device designed to bring or condition air of a room, hereinafter referred to as room air, to a certain or predefined state and/or to change the temperature, the humidity, the purity and/or the (dust) particle concentration of the room air. However, an air conditioner/climate control device within the sense of the present invention may also be designed to exclusively clean and/or filter the room air.

The proposed method for operating a cleaning system with a cleaning device and a base station for the cleaning device is characterized in that—in particular before, during and/or after a cleaning process by means of the cleaning device and/or before, during and/or after a maintenance or suction process by means of the base station—room air is conditioned/climatized, in particular cleaned, heated, cooled, humidified and/or dehumidified, by means of the base station, in particular by an (integrated) air conditioner/climate control device in the base station. In this way, corresponding advantages are realized.

According to a particularly preferred method variant, the room air is aftertreated by means of the air conditioner/climate control device during the maintenance process and/or suction process by the base station, in particular before the room air—as delivery/conditioned/fresh air—is (re)released to the environment/surroundings.

Preferably, during a maintenance process and/or suction process, room air is sucked together with vacuumed material from the cleaning device into the base station and the vacuumed material is collected in the container of the base station and/or separated from the sucked-in room air. The (cleaned) room air can then be fed/conducted to the climate control device for after-treatment and/or conditioning, in particular before the room air—as delivery/conditioned/fresh air—is (re)released to the environment/surroundings.

Advantageously, in such a method, a pleasant indoor climate is maintained or established during and/or by the operation of the base station and/or a suction process, and/or it is prevented that the operation of the base station has a negative effect on the indoor climate.

According to a further method variant, which can also be implemented independently, the quality, in particular the particle concentration, particle number, particle size, humidity and/or temperature, of the room air is measured by means of the base station, in particular an (integrated) measuring device in the base station, in particular before, during and/or after a cleaning process by means of the cleaning device and/or before, during and/or after a maintenance process or suction process by means of the base station.

In addition or alternatively, the quality, in particular the particle concentration, particle number, particle size, humidity and/or temperature, of the room air is measured by means of the cleaning device, preferably during a cleaning process and/or at different locations in a room to be cleaned.

Preferably, depending on the measured values, the (air) conditioning/climatization is controlled, in particular (automatically) started, stopped and/or adjusted, by means of the base station, in particular the climate control device.

Preferably, the measured values are exchanged between the cleaning device and the base station (in terms of a data connection), in particular in order to compare the measured values with each other and/or to use the measured values of the cleaning device to control the base station, in particular the climate control device.

For example, in the event of a particularly high particle or dust concentration, it is possible to (automatically) start a cleaning process by means of the cleaning device and/or the (air) conditioning/climatization, in particular the cleaning, by means of the base station or climate control device.

The aforementioned aspects, features, method steps and method variants of the present invention as well as the aspects, features, method steps and method variants of the present invention resulting from the claims and the following description can in principle be realized independently of each other, but also in any combination or sequence.

Further aspects, advantages, features and properties of the present invention result from the claims and the following description of a preferred embodiment with reference to the accompanying drawings.

DETAILED DESCRIPTION

In the partly not to scale, only schematic figures, the same reference signs are used for the same, identical or similar parts and components, wherein corresponding or comparable properties, characteristics and advantages are achieved, even if a repeated description is omitted.

Figure 1:
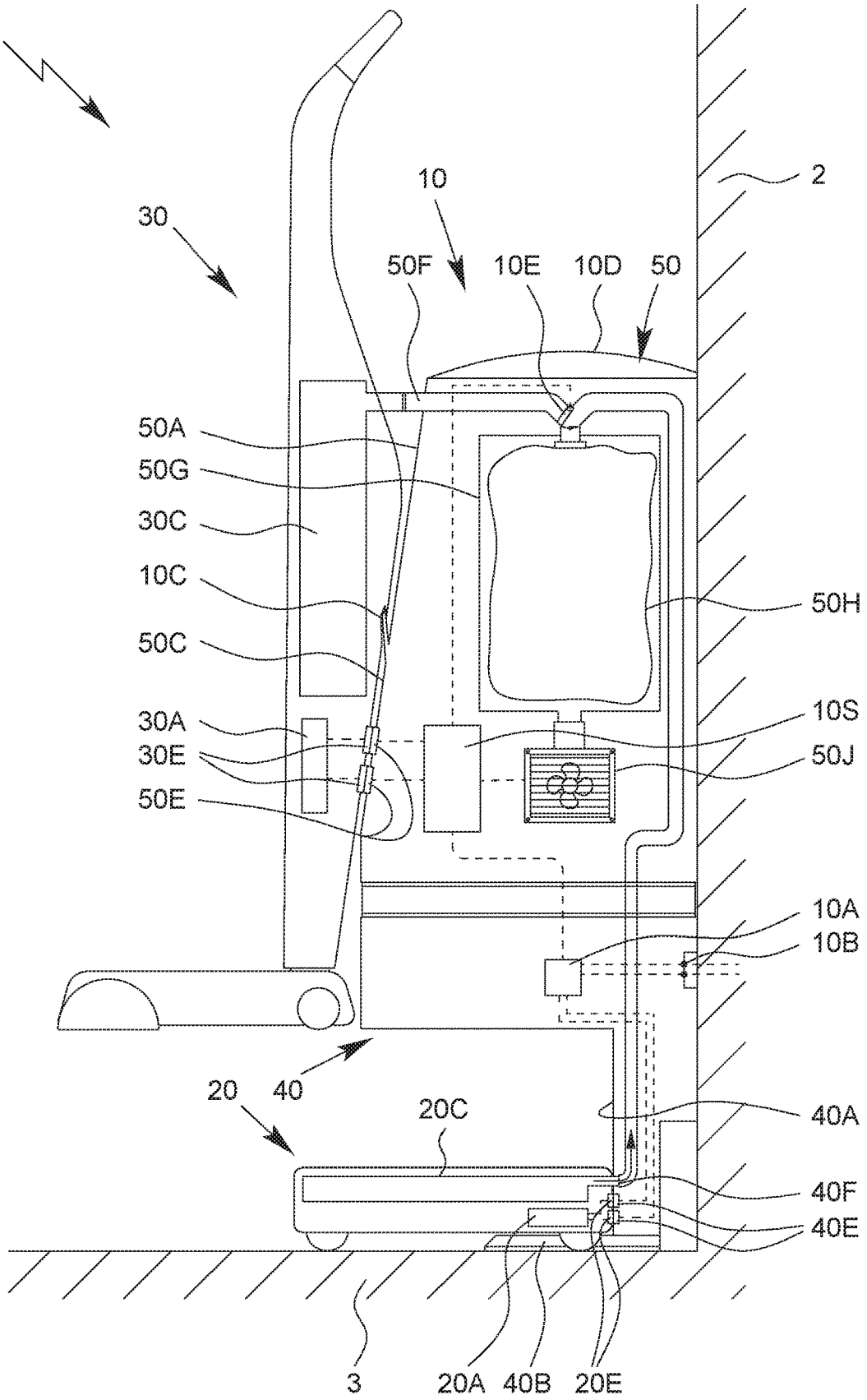
FIG. 1 is a schematic side view of a proposed cleaning system with a proposed base station and a plurality of cleaning devices connected thereto.

FIG. 1 schematically shows a proposed cleaning system 1 with a proposed base station 10.

The illustration in FIG. 1 shows the cleaning system 1/the base station 10 in the installed/mounted state or in the usual position of use, in which the base station 10 (at the rear) rests or is fastened to a wall 2 and preferably (at the bottom/floor side) rests on a floor 3 or ends or is arranged close to the floor 3.

The cleaning system 1 is preferably equipped with a plurality of components.

Preferably, the cleaning system 1—in addition to the base station 10—has at least one (mobile) cleaning device 20, 30, wherein the cleaning device 20, 30 can be coupled fluidically, in particular pneumatically, and/or electrically with the base station 10, in particular to empty/suck out and/or electrically charge the cleaning device 20, 30, as explained in more detail below.

In the embodiment shown in FIG. 1, the cleaning system 1 has a plurality of, here two different, cleaning devices 20, 30, wherein in this case a first cleaning device 20 is designed as a cleaning robot and a second cleaning device 30 as a hand vacuum cleaner. However, other constellations are also conceivable, for example in which the cleaning system 1 has a plurality of cleaning robots.

Individual or a plurality of aspects, advantages, features, properties, characteristics and method steps, which are only described in connection with one of the cleaning devices 20, 30, are preferably also provided for the other one of the cleaning devices 20, 30, so that corresponding explanations also apply to the other one of the cleaning devices 20, 30.

In the following, the use of the base station 10 with two cleaning devices 20, 30 is described. However, it is also possible that the cleaning system 1 has only one cleaning device 20, 30 or that the base station 10 is used with only one cleaning device 20, 30.

The cleaning system 1 is especially used indoors or for indoor cleaning. However, it is also in principle possible to use the cleaning system 1 in outdoor spaces/areas or to use it for cleaning outdoor spaces or areas.

As already explained at the outset, the base station 10 is designed for electrical and/or fluidic connection and/or for maintenance, in particular for (electrical) charging and/or for (automated) emptying or sucking out, of one or more cleaning devices 20, 30. For this purpose, the cleaning devices 20, 30 are coupled to the base station 10, whereby a fluidic, in particular pneumatic, and/or electrical connection is established—preferably automatically—between the base station 10 and the cleaning devices 20, 30.

The connecting/coupling of the cleaning devices 20, 30 to the base station 10 can be done manually—for example in the case of a hand vacuum cleaner—or automatically or in a self-acting manner—for example in the case of a cleaning robot. In the embodiments shown, it is provided that the first cleaning device 20 connects to the base station 10 automatically or in a self-acting manner after a cleaning process and the second cleaning device 30 is hung into the base station 10 manually or by a user, in order to electrically charge and/or suck out the cleaning devices 20, 30 by means of the base station 10.

The base station 10 is preferably elongated/oblong and/or box-shaped and/or cabinetlike.

It is preferable that the base station 10 is fixed or immovably connected or connectable to the wall 2. However, the base station 10 can in principle also be designed as a freestanding and/or mobile or movable device.

Preferably, the base station 10 is mounted on the wall 2 in such a way that the base station 10, when installed/mounted, rests on the floor 3 and lies flat against the wall 2. However, other solutions are also possible here, in particular in which the base station 10 in the installed/mounted state is arranged at a distance from the floor 3 and/or suspended from the wall 2.

The base station 10 is preferably of multi-part and/or modular construction. Especially preferably, the base station 10 has a plurality of modules or can be expanded/upgraded by one or more modules.

The base station 10 preferably has a bottom module 40 and/or a head module 50, in particular wherein the head module 50 is arranged (directly) above the bottom module 40 in the position of use or in the installed/mounted state.

Preferably, the bottom module 40 is designed for the electrical and/or fluidic connection of the first cleaning device 20 and/or the head module 50 is designed for the electrical and/or fluidic connection of the second cleaning device 30.

It is thus provided to (electrically) charge and/or to empty the first cleaning device 20 by means of the bottom module 40 and/or the second cleaning device 30 by means of the head module 50, in particular from the side, from below and/or from above.

FIG. 1 shows the cleaning system 1 and/or the cleaning devices 20, 30 in the coupling or connection position, in which the cleaning devices 20, 30 are electrically and/or pneumatically connected to the base station 10.

The base station 10 preferably has a (first) electrical connection 40E for the first cleaning device 20 and/or a (second) electrical connection 50E for the second cleaning device 30 in order to electrically connect the base station 10 to the cleaning device 20 or 30, respectively, and to charge an accumulator 20A or 30A, only indicated schematically, of the cleaning device 20 or 30, respectively. Preferably, the first electrical connection 40E is located in the bottom module 40 and the second electrical connection 50E in the head module 50.

The electrical connection(s) 40E and/or 50E are/is preferably formed by one or more electrical contacts or—in particular for wireless power transmission—by one or more coils.

The cleaning device 20 or 30 has an electrical connection 20E or 30E corresponding to the electrical connection 40E or 50E, respectively, which is preferably formed by one or more electrical contacts or—in particular for wireless power transmission—by one or more coils on an outer side of the respective cleaning device 20 or 30.

The base station 10, in particular the bottom module 40, is equipped with an optional power supply unit 10A—preferably with corresponding charging electronics—and/or a power connection 10B for connection to a power supply system or a mains/grid only indicated schematically, in order to enable a power supply of the first cleaning device 20 in particular via the first electrical connection 40E and/or of the second cleaning device 30 in particular via the second electrical connection 50E, as indicated by dashed lines in FIG. 1.

Preferably, the base station 10, in particular the bottom module 40, forms a receiving space 40A for the first cleaning device 20 in order to at least partially accommodate/receive the first cleaning device 20. The first cleaning device 20 can thus at least partially enter or drive into the bottom module 40 to establish a fluidic and/or electrical connection with the base station 10 or bottom module 40.

The base station 10, in particular the head module 50, is preferably designed to hold and/or partially accommodate/receive the second cleaning device 30. In particular, the second cleaning device 30 can be attached to the head module 50 and/or suspended/hung/hooked in the head module 50.

Preferably, the base station 10, in particular the head module 50, has a holder 10C to hold the second cleaning device 30, in particular in a form-fit and/or force-fit manner and/or above or at a distance from the floor 3.

In the embodiment shown, the holder 10C is formed by a hook, the second cleaning device 30 having a bracket corresponding to the hook for suspending the cleaning device 30. However, other solutions are also possible here.

The base station 10, in particular the head module 50, has an in particular box-shaped housing 50A, preferably wherein the housing 50A has or forms the holder 10C.

In a particularly preferred embodiment, the electrical connection 50E is integrated in the holder 10C.

Preferably, the electrical and/or fluidic connection between the base station 10, in particular the head module 50, and the second cleaning device 30 is established by or at the same time as attaching/hanging or mechanically coupling the cleaning device 30 to the base station 10 or the head module 50.

The base station 10 preferably has a (first) fluidic, in particular pneumatic, connection 40F for the first cleaning device 20 and/or a (second) fluidic, in particular pneumatic, connection 50F for the second cleaning device 30 in order to connect the base station 10 fluidically, in particular pnematically, to the cleaning device 20 and/or 30, preferably with the first fluidic connection 40F being arranged in the bottom module 40 and the second fluidic connection 50F in the head module 50.

The (respective) fluidic connection 40F or 50F of the base station 10 is preferably formed by a connecting piece, an opening or the like, for example in a foot part 40B of the bottom module 40 and/or on a front side 50C of the head module 50, and/or is located directly next to the (respective) electrical connection 40E or 50E.

In a particularly preferred embodiment, the fluidic connection 50F of the head module 50 is integrated into the holder 10C for the second cleaning device 30.

It is preferable that the (respective) cleaning device 20 or 30 connects both fluidically and electrically to the base station 10 (automatically) when it drives onto the foot part 40B and/or against the base station 10, in particular the bottom module 40, and/or when it is hooked/hung into the base station 10, in particular the head module 50, and/or when it is in the connection position.

The base station 10, in particular the head module 50, preferably has a container 50G, a filter 50H and/or a fan or blower 50J, preferably wherein the fluidic connection(s) 40F and/or 50F are/is fluidically connected to the container 50G, the filter 50H and/or the blower 50J.

The filter 50H is preferably a (disposable) filter bag or a (disposable) filter cartridge, which is preferably exchanged or replaced by a new filter or a new filter cartridge after use or when a certain filling quantity is reached.

Preferably, the filter 50H is arranged in the container 50G and/or attached to an inlet of the container 50G.

By connecting the cleaning device 20 or 30 to the base station 10, respectively, a fluidic connection is preferably established between a chamber 20C or 30C of the respective cleaning device 20 or 30, which is only indicated schematically, and the base station 10 and/or the head module 50, in particular the container 50G and/or the blower 50J.

By means of the blower 50J, it is possible to convey, in particular to suck, a fluid, in particular vacuumed material or air together with vacuumed material, from the cleaning device 20 and/or 30, in particular the chamber 20C and/or 30C, to the base station 10 or into its container 50G.

In the connection position of the cleaning device 20 and/or 30, the cleaning device(s) 20 and/or 30 are/is thus fluidically, particularly preferably both fluidically and electrically, connected to the base station 10, in particular in such a way that the chamber(s) 20C and/or 30C of the cleaning device(s) 20 and/or 30 can be emptied and/or the accumulator(s) 20A and/or 30A can be charged. In the connection position, a maintenance process, in particular a suction and/or charging process, of the cleaning device(s) 20 and/or 30 can be carried out by means of the base station 10.

For example, in the connection position and/or during a maintenance or suction process, vacuumed material can be sucked from the chamber 20C of the first cleaning device 20 via the fluidic connection 40F of the bottom module 40 and/or vacuumed material can be sucked from the chamber 30C of the second cleaning device 30 via the fluidic connection 50F of the head module 50, and the vacuumed material can be transferred (in both cases) into the (common) container 50G. In this way, manual emptying of the cleaning devices 20, 30 can be omitted.

The container 50G preferably has a volume that is larger than the volume of the chamber 20C of the first cleaning device 20 and/or the chamber 30C of the second cleaning device 30, preferably by double or triple the size, so that the entire contents of the chamber 20C and/or 30C can be collected/received by the container 50G. Particularly preferably, the volume of the container 50G is greater than the combined volume of the chamber 20C of the first cleaning device 20 and the chamber 30C of the second cleaning device 30, in particular by at least double or triple the size. In this way, it is possible to take up the entire contents of both chambers 20C, 30C of the cleaning devices 20, 30 into the container 50G.

The container 50G preferably has a volume of more than 1 l or 1.5 l, especially preferably more than 2 l or 3 l.

Preferably, the base station 10, in particular the head module 50, is equipped with a flap 10D to open and/or empty the base station 10, in particular the container 50G, and/or to change the filter 50H.

In the embodiment shown, the flap 10D is designed as a removable or swivelling lid. However, it is also possible, for example, to provide the front side 50C with the flap 10D.

The container 50G and/or the filter 50H has an inlet, wherein in the embodiment shown both cleaning devices 20, 30 and/or both fluidic connections 40F, 50F are connected to the inlet fluidically and/or via corresponding lines.

Preferably, the base station 10 has an optional (controlled) shut-off apparatus 10E, such as a shut-off flap or a (butterfly) valve, to control the air flow and/or the air routing/air conduction. In particular, by means of the shut-off apparatus 10E, it is possible to connect selectively the first cleaning device 20/the fluidic connection 40F or the second cleaning device 30/the fluidic connection 50F fluidically to the container 50G and/or the filter 50H.

The base station 10 preferably has a control device 10S, which controls the (electrical) charging and/or the emptying of the cleaning devices 20, 30. For this purpose, the control device 10S is preferably electrically connected to the (first) electrical connection 40E, the (second) electrical connection 50E, the power supply unit 10A, the blower 50J and/or the shut-off apparatus 10E, as indicated by dashed lines in FIG. 1.

In the following, the air routing/air guidance/air conduction of the cleaning system 1 is described in more detail based on FIG. 2, wherein only the first cleaning device 20 is shown. However, a corresponding air routing/air guidance/air conduction can also be provided for the optional other cleaning device 30.

The cleaning device 20 has an intake/suction opening 20B, an intake/suction line 20D, a fluidic connection 20F, a feed/supply/inlet line 20G, a connecting line 20H, a fan or blower 20J, an outlet line 20L, an outlet opening 20N and/or a suction/emptying line 20P.

The lines 20D, 20G, 20H, 20L and/or 20P are designed as air-carrying, air-guiding and/or pneumatic lines in the cleaning device 20 and enable the transport of a medium, in particular air, in the cleaning device 20.

The openings 20B and/or 20N are designed as openings or through holes in the housing of the cleaning device 20 and enable an air exchange between the cleaning device 20, in particular the chamber 20C, and the surroundings.

In the cleaning mode of the cleaning device 20, for example when the cleaning device 20 is used to clean the floor 3 and/or is performing a cleaning process, air can be sucked together with material to be vacuumed from the surroundings into the cleaning device 20, in particular the chamber 20C, via the intake/suction opening 20B and/or intake/suction line 20D by means of the blower 20J.

In the chamber 20C, the vacuumed material is separated from the air in the cleaning mode of the cleaning device 20 and/or during the cleaning process, for example by means of a filter not shown, so that the (cleaned) air can be released back to the surroundings, in particular via the connecting line 20H, the blower 20J, the outlet line 20L and the outlet opening 20N.

The intake opening 20B is preferably located at the bottom and/or on an underside of the cleaning device 20 and connected to the chamber 20C via the intake line 20D and/or the feed line 20G.

Preferably, the blower 20J is fluidically connected to the chamber 20C via the connecting line 20H and/or located downstream to the chamber 20C in the cleaning mode of the cleaning device 20.

The chamber 20C is therefore preferably located fluidically between the intake opening 20B/the intake line 20D on one side and the blower 20J/the outlet opening 20N on the other side.

The air routing and/or the direction of flow is changed at least partially or in sections in the suction mode or during sucking out by means of the base station 10 compared to the cleaning mode. In particular, the direction of flow in chamber 20C is reversed in suction mode compared to cleaning mode.

In the following, a distinction is therefore made between the cleaning mode and the suction mode of the cleaning device 20. In FIG. 2 the preferred flow direction in the suction mode or during a maintenance process or suction process is shown by arrows.

The cleaning mode is the mode in which the cleaning device 20 is in during cleaning and/or while performing a cleaning process.

A cleaning process within the sense of the present invention is preferably a process in which cleaning is carried out by means of the cleaning device 20 and/or in which the cleaning device 20 cleans and/or vacuums a surface, such as the floor 3.

Usually, in the cleaning mode and/or during a cleaning process, the cleaning device 20 is not connected to and/or is spaced from the base station 10.

In particular, the blower 20J is activated or switched on in the cleaning mode of the cleaning device 20 and/or during a cleaning process, in particular so that air flows from the intake opening 20B to the outlet opening 20N. Particularly preferably, in cleaning mode, air flows from the intake opening 20B via the intake line 20D and/or the feed line 20G into the chamber 20C and from the chamber 20C via the connecting line 20H and the blower 20J to the outlet line 20L and/or outlet opening 20N.

Thus, the intake opening 20B and the intake line 20D form the intake tract of the cleaning device 20 in cleaning mode.

The suction mode is the mode in which the cleaning device 20 is in during sucking out by means of the base station 10 and/or during a maintenance process or suction process.

A maintenance process in the sense of the present invention is preferably a process in which the cleaning device 20 is maintained by means of the base station 10. A maintenance process may be a suction process and/or a charging process. In particular, the cleaning device 20 can be at least partially, preferably completely, sucked out by a maintenance process and/or a suction process, and the cleaning device 20 can be at least partially, preferably completely, charged by a maintenance process and/or a charging process.

In maintenance mode and/or suction mode and/or during a maintenance process, the cleaning device 20, in particular the fluidic connection 20F and/or the electrical connection 20E of the cleaning device 20, is connected to the base station 10, in particular the fluidic connection 40F and/or the electrical connection 40E of the base station 10.

In particular, the blower 20J of the cleaning device 20 is deactivated or switched off in the maintenance mode and/or suction mode and/or during a maintenance process of the cleaning device 20.

Sucking out/emptying is preferably carried out via the fluidic connection 20F and/or the suction/emptying line 20P of the cleaning device 20. In particular, it is possible to suck out the chamber 20C by means of the base station 10 via the fluidic connection 20F and/or the suction line 20P.

The fluidic connection 20F is preferably formed by a connection piece, an opening or the like in the cleaning device 20, in particular in the housing of the cleaning device 20. In the embodiment shown, the connection 20F is arranged on a top side of the cleaning device 20.

Preferably, the fluidic connection 20F is fluidically connected to the chamber 20C via the suction line 20P.

The cleaning device 20 preferably has a suction/emptying valve 20Q to control and/or change the air flow or air routing/guidance in the cleaning device 20, in particular to change/switch between the cleaning mode and the suction mode.

Preferably, by means of the suction valve 20Q, selectively the intake opening 20B or the connection 20F is fludically connectable to the chamber 20C.

In cleaning mode and/or during a cleaning process, the intake opening 20B is fluidically connected to the chamber 20C in order to be able to suck in air from the surroundings and/or to feed/conduct it into the chamber 20C via the feed line 20G. Preferably, the connection 20F is fluidically separated from the chamber 20C in cleaning mode.

In suction mode, the fluidic connection 20F is fluidically connected to the chamber 20C to conduct air and/or vacuumed material from the chamber 20C and the optional feed line 20G to the connection 20F/the base station 10. Preferably, the intake opening 20B is fluidically separated from the chamber 20C in suction mode.

Preferably, (ambient) air or room air RL flows from the outlet opening 20N to the fluidic connection 20F during sucking out and/or in suction mode. Particularly preferably, (ambient) air or room air RL flows during the sucking out and/or in the suction mode via the outlet line 20L, the blower 20J and/or the connecting line 20H into the chamber 20C and from the chamber 20C via the feed line 20G and the suction/emptying line 20P through the cleaning device 20 and/or to the fluidic connection 20F and/or into the base station 10.

Thus, the outlet opening 20N and the outlet line 20L form the intake tract of the cleaning device 20 in suction mode and/or during a maintenance process or suction process.

Figure 2:
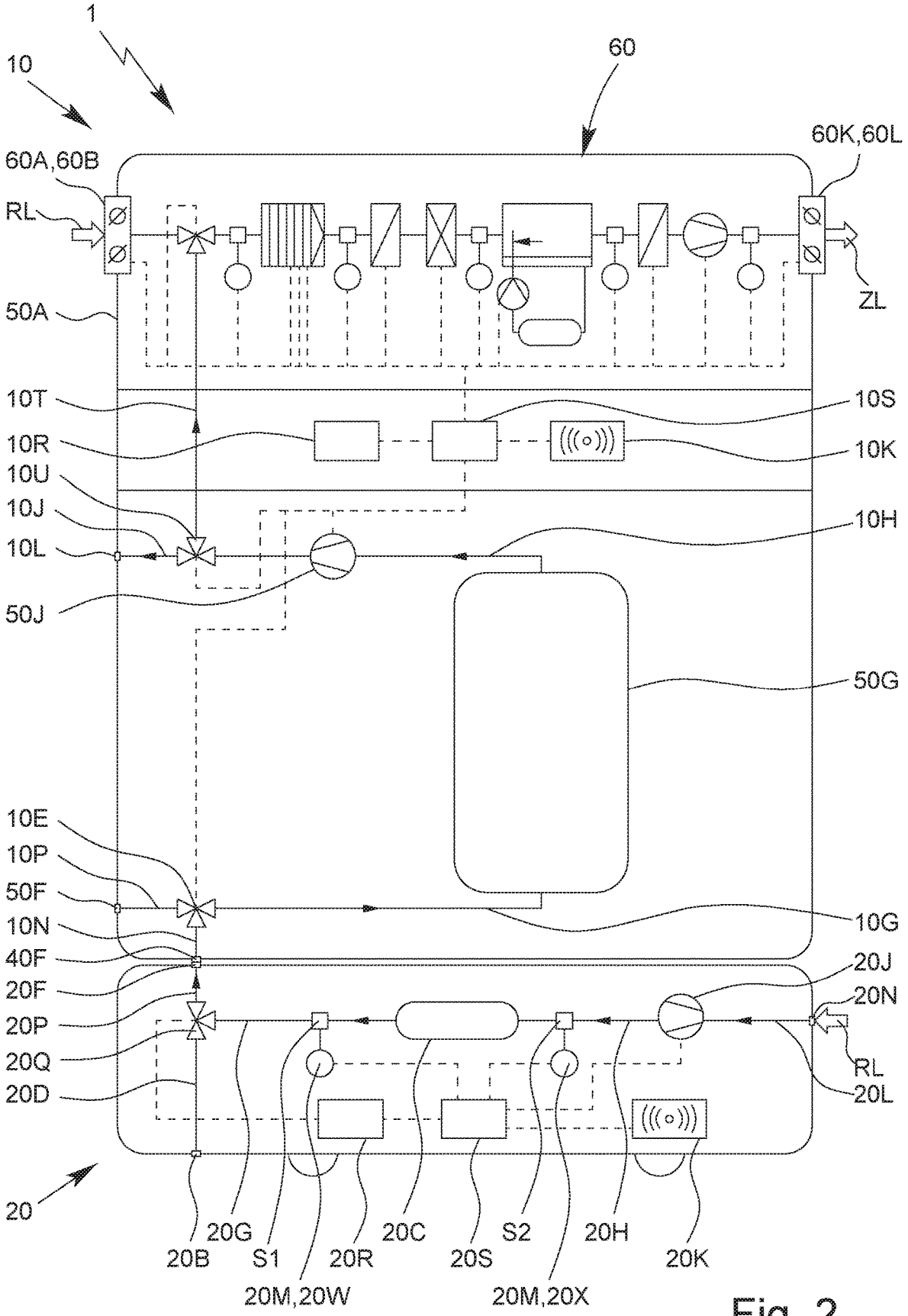
FIG. 2 is a schematic pneumatic diagram of the cleaning system according to FIG. 1 with only one cleaning device connected thereto.

The cleaning device 20 preferably comprises a control apparatus 20S, a data processing apparatus 20R and/or a communication apparatus 20K, preferably wherein the control apparatus 20S, the data processing apparatus 20R, the communication apparatus 20K, the blower 20J and/or the suction valve 20Q are electrically connected to each other, as indicated by dashed lines in FIG. 2.

The control apparatus 20S is preferably designed to control the blower 20J, in particular to activate or deactivate it and/or to adjust the power of the blower 20J.

In addition, the control apparatus 20S is preferably designed to control the suction valve 20Q and/or to adjust the switch position of the suction valve 20Q.

The cleaning device 20 is preferably equipped with a measuring apparatus 20M to measure the air quality, in particular the size, number, concentration and/or density of (dust) particles in the room air RL, the temperature of the room air RL and/or the (relative) humidity of the room air RL.

Preferably, the cleaning device 20 and/or the measuring apparatus 20M has one or more (different) measuring points S1, S2.

In the embodiment shown, a (first) measuring point S1 is located in the feed line 20G and/or in the cleaning mode of the cleaning device 20 (directly) upstream to the chamber 20C and/or a (second) measuring point S2 is located in the connecting line 20H and/or in the suction mode of the cleaning device 20 (directly) upstream to chamber 20C. However, other embodiments are also possible, for example in which the measuring point(s) S1 and/or S2 are/is located in the intake opening 20B, the fluidic connection 20F, the outlet opening 20N and/or on an outside of the housing.

The cleaning device 20 and/or the measuring apparatus 20M preferably has one or more sensors 20W, 20X. In the embodiment shown, the measuring apparatus 20M has a first sensor 20W for the first measuring point S1 and a second sensor 20X for the second measuring point S2.

The measuring apparatus 20M is preferably designed to measure or determine the size, number, concentration and/or density of particles in the room air RL, the temperature of the room air RL and/or the (relative) humidity of the room air RL at the measuring point(s) S1 and/or S2.

The sensor(s) 20W and/or 20X are/is preferably a dust sensor or particle counter, a humidity sensor or hygrometer and/or a temperature sensor or thermometer.

A dust sensor in the sense of the present invention is a sensor for detecting the size, number, concentration and/or density of particles in a medium, such as air. Preferably, a dust sensor is an optical sensor, and/or a dust sensor comprises a light source, a measuring cell and a detector, preferably for detecting scattered light of the particles in the measuring cell by means of the detector.

The measuring apparatus 20M, in particular the sensor(s) 20W and/or 20X, is preferably electrically connected to the control apparatus 20S, the data processing apparatus 20R and/or the communication apparatus 20K, in particular in order to process and/or evaluate the measured values and/or transmit them to the base station 10 and/or another device, as further explained below.

The base station 10 preferably has a feed/supply/inlet line 10G, a blower line 10H, an outlet line 10J and/or an outlet opening 10L, preferably wherein the container 50G is fluidically connected via the feed line 10G to the fluidic connection(s) 40F and/or 50F and/or via the blower line 10H and/or the outlet line 10J to the outlet opening 10L.

In the embodiment shown, the base station 10 has a first connection line 10N and a second connection line 10P, wherein the first fluidic connection 40F is fluidically connected or connectable to the feed line 10G and/or the container 50G via the first connection line 10N and the second fluidic connection 50F is fluidically connected or connectable to the feed line 10G and/or the container 50G via the second connection line 10P.

The lines 10G, 10H, 10J, 10N and/or 10P are designed as air-carrying, air-guiding and/or pneumatic lines in the base station 10 and enable the transport of a medium, in particular air and/or vacuumed material, in the base station 10.

The outlet opening 10L is designed as an opening or through hole in the housing 50A of the base station 10 and enables the exchange of air between the base station 10, in particular the container 50G, and the surroundings.

As already explained, by means of the optional shut-off apparatus 10E, selectively the fluidic connection 40F or the fluidic connection 50F ist fluidically connectable to the container 50G and/or the blower 50J.

The blower 50J is preferably fluidically connected via the blower line 10H to the container 50G and/or via the outlet line 10J to the outlet opening 10L and/or the surroundings. In particular, the blower 50J is arranged fluidically between the container 50G and the outlet opening 10L.

Figure 3:
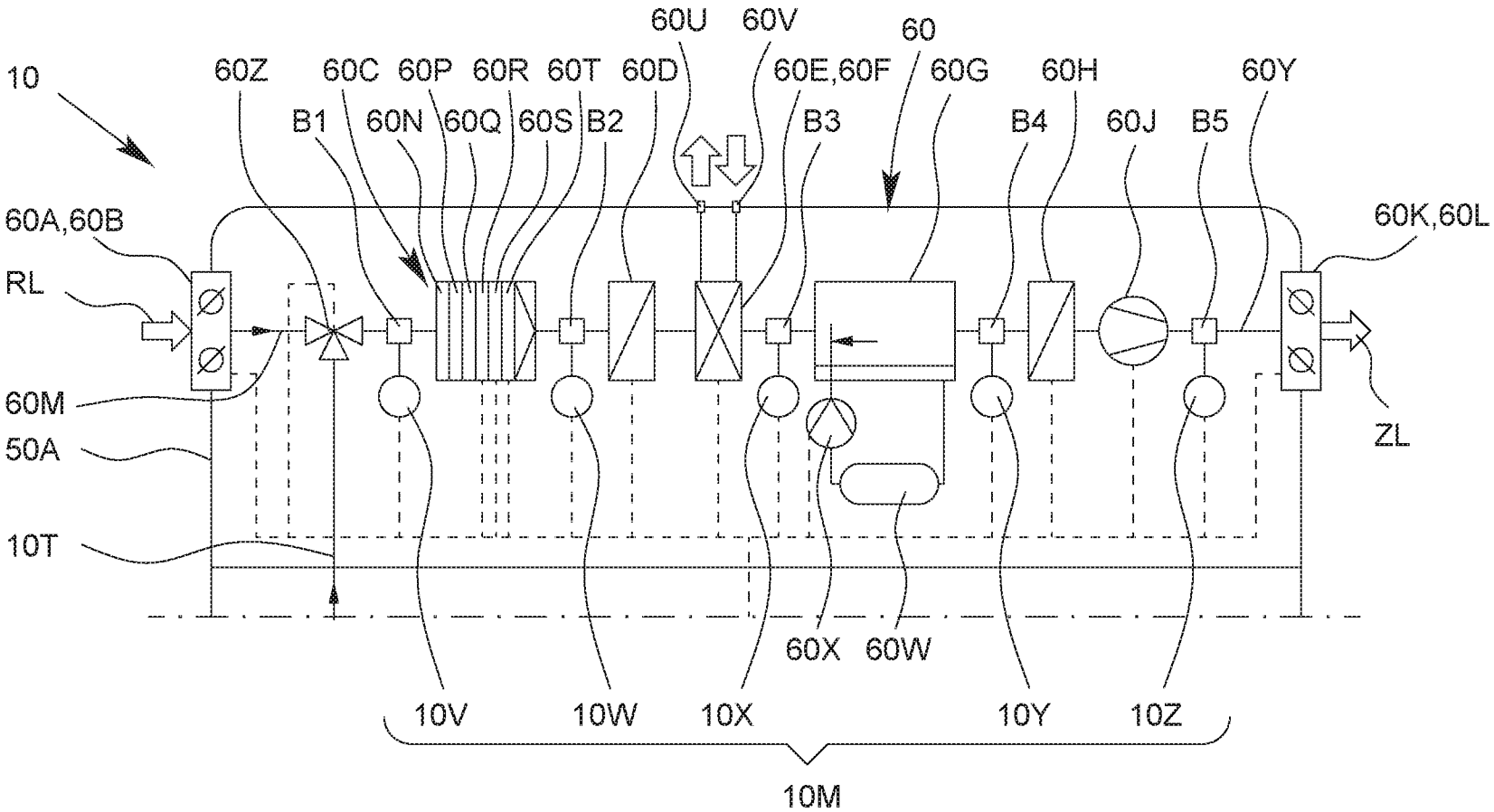
FIG. 3 is the schematic pneumatic diagram of the cleaning system according to FIG. 2 in the region of a climate control device.

The base station 10 preferably comprises a control device 10S, a data processing device 10R, a communication device 10K and/or a measuring device 10M, preferably wherein the control device 10S, the data processing device 10R, the communication device 10K, the measuring device 10M, the shut-off apparatus 10E and/or the blower 50J are electrically connected to each other, as indicated by dashed lines in FIG. 2 and FIG. 3.

When the cleaning device 20 is sucked out and/or during a maintenance process or suction process, vacuumed material or air together with vacuumed material is transferred or sucked from the cleaning device 20, in particular the chamber 20C, into the base station 10, in particular the container 50G, in particular by means of the blower 50J.

In the container 50G of the base station 10, vacuumed material is separated from the air, for example by means of the filter 50H (not shown in FIG. 2), so that the (cleaned) air can be released back to the surroundings, in particular via the blower line 10H, the blower 50J, the outlet line 10J and/or the outlet opening 10L.

The base station 10 preferably has an air conditioner/climate control device 60 for conditioning/climatization of the room air RL and/or for the release of conditioned delivery air ZL. In the following, the structure and the mode of operation of the climate control device 60 is explained in more detail using FIG. 3, which shows a detail of the base station 10 in the region of the climate control device 60.

The climate control device 60 is preferably integrated into the base station 10, in particular the bottom module 40 or the head module 50, and/or is arranged within the housing 50A of the base station 10. However, it is also possible for the climate control device 60 to be designed as a separate module, which can, for example, be mounted (retrospectively) on the head module 50.

The climate control device 60 is preferably designed for cleaning, humidifying, dehumidifying, heating and/or cooling the room air RL. In particular, by means of the climate control device 60, room air RL can be sucked in from the surroundings, cleaned/filtered, humidified, dehumidified/dried, heated, cooled and/or emitted/released (again) to the surroundings in a conditioned and/or processed state and/or as delivery/conditioned/fresh air ZL.

The term "room air" in the sense of the present invention is preferably to be understood as the ambient air and/or the air in the room in which the cleaning system 1 and/or the base station 10 and/or the cleaning device 20 is used. Preferably, the room air RL is the air which is sucked in by means of the base station 10, in particular in order to measure and/or adjust the condition and/or quality of the air, in particular the purity and/or particle concentration, the humidity and/or the temperature.

The term "delivery air" or "conditioned air" in the sense of the present invention is preferably to be understood as the air emitted/released by the base station 10 to the environment/surroundings. Preferably, the delivery air ZL is the (ambient) air or room air RL climatized/conditioned by means of the base station 10, in particular the climate control device 60.

The climate control device 60 preferably operates independently and/or has its own air routing/air guidance, which is preferably decoupled from the air routing/air guidance for the sucking out of the cleaning device 20 and/or 30. However, solutions are also possible in which the climate control device 60 is connected fluidically and/or pneumatically to the container 50G and/or is arranged downstream of the container 50G, as explained in more detail below.

The climate control device 60 has an inlet 60A with an optional inlet flap 60B, a filter arrangement 60C, an optional preheater 60D, a cooler 60E, a dehumidifier 60F, a humidifier 60G, a heater 60H, a fan or blower 60J and/or an outlet 60K with an optional outlet flap 60L.

The inlet 60A and the outlet 60K are designed as openings or through holes in the housing 50A and enable air exchange between the base station 10, in particular the climate control device 60, and the surroundings.

By means of the optional inlet flap 60B and/or outlet flap 60L, it is possible to open or close the inlet 60A and/or outlet 60K and/or to change the flow cross-section of the inlet 60A and/or outlet 60K.

The filter arrangement 60C is preferably arranged (directly) downstream of the inlet 60A and/or connected to the inlet 60A via an inlet line 60M.

The filter arrangement 60C is designed for cleaning/filtering the room air RL and/or designed to retain, separate, decompose and/or split particles/suspended matter, in particular dust, bacteria, viruses, pollen, mite eggs or the like.

The filter arrangement 60C is designed with one or more stages and/or has one or more filters or filter stages.

Preferably, the filter arrangement 60C has a pre-filter 60N, a suspended matter filter 60P, an activated carbon filter 60Q, a photocatalyst 60R, an ozone generator 60S and/or an electric filter 60T.

The pre-filter 60N is preferably designed as a grid, sieve or fleece filter and/or provided to separate larger particles, for example with an aerodynamic diameter of more than 1 μm or 2 μm.

The suspended matter filter 60P is preferably arranged directly downstream of the prefilter 60N and/or is designed to separate particles with an aerodynamic diameter of less than 1 μm or 0.5 μm.

The suspended matter filter 60P is preferably designed as an ULPA, HEPA or EPA filter.

By means of the suspended matter filter 60P it is possible to remove smallest particles, such as fine dust, bacteria and/or viruses, from the room air RL.

Preferably, the suspended matter filter 60P has filter class H13 or H14 according to the European standard DIN EN 1822-1:2011-01.

The activated carbon filter 60Q is preferably arranged downstream of the pre-filter 60N and/or the suspended matter filter 60P.

The activated carbon filter 60Q is preferably designed to separate or break down dust, in particular fine dust, heavy metals, ozone and/or pollutants from the room air RL.

The photocatalyst 60R is preferably arranged downstream of the pre-filter 60N, the suspended matter filter 60P and/or the activated carbon filter 60Q.

The photocatalyst 60R is preferably designed as a UV filter and/or is designed to decompose organic substances and/or to oxidize gaseous substances by means of photocatalysis and/or by UV radiation and titanium dioxide as a catalyst.

The ozone generator 60S is preferably arranged downstream of the pre-filter 60N, the suspended matter filter 60P, the activated carbon filter 60Q and/or the photocatalyst 60R.

The ozone generator 60S is preferably designed for the production of ozone, in particular to decompose organic compounds, such as bacteria or viruses, by means of ozone as oxidizing agent. In particular, the room air RL is at least partially disinfected by means of the ozone generator 60S.

The electric filter 60T is preferably arranged downstream of the pre-filter 60N, the suspended matter filter 60P, the activated carbon filter 60Q, the photocatalyst 60R and/or the ozone generator 60S.

The electric filter 60T is preferably designed as an electrostatic filter, electrostatic precipitator and/or ionizer and/or is designed to separate particles in an electric field.

By means of the filter arrangement 60C, in particular the different filter stages of the filter arrangement 60C, it is possible both to separate particles in the room air RL and to decompose organic compounds, in particular in order to reduce odors/smells in the room air RL, which are caused in particular by organic compounds.

The preheater 60D and/or the heater 60H are/is designed to heat the room air RL. For this purpose, the preheater 60D and/or the heater 60H preferably comprise(s) electric heating and/or electric heating rods.

The cooler 60E is designed to cool the room air RL and/or to extract heat from the room air RL, in particular by means of a refrigerant, a (direct) evaporator, a condenser, a compressor and/or a pump (not shown).

Optionally, the climate control device 60, in particular the cooler 60E, has an exhaust air connection 60U in order to dissipate/discharge heat and/or exhaust air, for example, by means of an exhaust air hose (not shown). In addition, the cooler 60E can have an outside air connection 60V to draw in outside air, for example, by means of a fresh air hose (not shown).

By means of the dehumidifier 60F, it is possible to extract water from the room air RL, in particular by cooling the room air RL in the dehumidifier 60F and/or in the cooler 60E to a temperature below the dew point temperature of the room air RL and leading it along a condensation surface (not shown).

In the embodiment shown, the cooler 60E and the dehumidifier 60F are designed as one device. However, it is also possible for the cooler 60E and the dehumidifier 60F to be two separate devices and/or to be spatially separated from each other.

The humidifier 60G is designed to increase the humidity of the room air RL and/or to release water into the room air RL. The humidifier 60G can be designed as a steam humidifier or vaporizer, as an evaporation humidifier or evaporator and/or as an aerosol sprayer or atomizer.

Preferably, the base station 10 and/or the climate control device 60, in particular the humidifier 60G, has a tank 60W for water for humidifying the room air RL. The tank 60W can preferably be filled via a corresponding inlet (not shown) of the base station 10 and/or the climate control device 60. By means of an optional, preferably electrically operated pump 60X, the water can be pumped from the tank 60W to the humidifier 60G.

By means of the blower 60J it is possible to suck in the room air RL from the surroundings and/or to convey it through the climate control device 60 and/or to compensate for pressure losses in the climate control device 60.

In the embodiment shown, the blower 60J is located downstream of the filter arrangement 60C and/or immediately upstream of the outlet 60K and/or connected to the outlet 60K via an outlet line 60Y. However, other arrangements are also possible here.

The climate control device 60 is preferably electrically operated and/or electrically connected to the power supply unit 10A (not shown in FIG. 2 and FIG. 3), the control device 10S, the data processing device 10R and/or the communication device 10K.

Preferably, the filter arrangement 60C, in particular the photocatalyst 60R, the ozone generator 60S and/or the electric filer 60T, the preheater 60D, the cooler 60E, the dehumidifier 60F, the humidifier 60G, the pump 60X, the heater 60H, the blower 60J, the inlet flap 60B and/or the outlet flap 60L are/is electrically connected to the power supply unit 10A, the control device 10S, the data processing device 10R and/or the communication device 10K, as indicated by dashed lines in FIG. 2 and FIG. 3.

As already explained, the climate control device 60 preferably operates independently, in particular independently of the blower 50J, and/or the climate control device 60 has its own and/or separate air routing/air guidance. In particular, the climate control device 60 can be operated independently of, especially preferably before, during and/or after, a suction process. In other words, the room air RL can preferably be conditioned and/or climatized independently of, in particular before, during and/or after, a suction process.

However, it is particularly preferred that the climate control device 60 is (pneumatically) coupled or can be (pneumatically) coupled (as required) with the fluidic connection(s) 40F and/or 50F, the container 50G, the filter 50H and/or the blower 50J, in particular in such a way that the air or room air RL sucked in by means of the fluidic connection 40F and/or 50F is led/conducted through the climate control device 60.

Preferably, the base station 10 has a (corresponding) connecting line 10T, which pneumatically connects the climate control device 60 with the fluidic connection(s) 40F and/or 50F, the container 50G, the filter 50H and/or the blower 50J, in particular in such a way that the (ambient) air or room air RL flowing out of the container 50G can be post-treated/after-treated by means of the climate control device 60.

Preferably, the connecting line 10T connects the filter arrangement 60C and/or the inlet line 60M of the climate control device 60 with the blower line 10H and/or the outlet line 10J.

Preferably, the base station 10 and/or the climate control device 60 has a valve 60Z, so that selectively the inlet 60A of the climate control device 60, on the one hand, or the fluidic connection(s) 40F and/or 50F and/or the container 50G, on the other hand, can be coupled with the climate control device 60, in particular the filter arrangement 60C. The valve 60Z is preferably arranged between the inlet 60A and the filter arrangement 60C and/or in the inlet line 60M.

Preferably, the connecting line 10T leads upstream of the filter arrangement 60C into the inlet line 60M of the climate control device 60, so that the fed air or room air RL can flow through the filter arrangement 60C and/or be cleaned and/or aftertreated by means of the filter arrangement 60C.

Optionally, the base station 10 has an outlet valve 10U to lead the air flow selectively directly to the surroundings or to the climate control device 60. The outlet valve 10U is preferably arranged downstream of the blower 50J and/or between the outlet opening 10L and the blower 50J and/or in the outlet line 10J.

The valve 60Z and the optional outlet valve 10U can, for example, be designed as a shut-off flap or butterfly valve or (three-)way valve or switching valve. Preferably, the valve 60Z and/or the outlet valve 10U are/is electrically connected to the control device 10S, as indicated by dashed lines in FIG. 2 and FIG. 3.

By means of the measuring device 10M it is possible to determine and/or measure the quality, in particular the particle number, particle size and/or particle concentration, the temperature and/or the humidity of the air, in particular of the room air RL and/or the delivery air ZL.

Preferably, the base station 10 and/or the climate control device 60 has one or more (different) measuring points B1 to B5 to determine and/or measure the quality, in particular the particle number, particle size and/or particle concentration and/or the temperature and/or the humidity of the air at one or more points in the base station 10, in particular in the climate control device 60.

The measuring points B1 to B5 are preferably arranged or distributed in the lines in the base station 10, in particular the climate control device 60. Particularly preferably, the measuring points B1 to B5 are arranged between the inlet 60A and the outlet 60K of the climate control device 60. However, it is also possible that one or more measuring points B1 to B5 are provided at other locations in or on the base station 10, for example in the blower line 10H, the connecting line 10T and/or on an outside of the housing 50A.

Preferably, a (first) measuring point B1 is arranged in the inlet line 60M and/or (directly) upstream to the filter arrangement 60C, a (further or second) measuring point B2 is arranged (directly) downstream to the filter arrangement 60C, a (further or third) measuring point B3 is arranged (directly) upstream to the humidifier 60G, a (further or fourth) measuring point B4 is arranged (directly) downstream to the humidifier 60G and/or a (further or fifth) measuring point B5 is arranged in the outlet line 60Y and/or (directly) upstream to the outlet 60K.

The measuring device 10M is preferably designed to measure the particle number, particle size and/or particle concentration, the temperature and/or the humidity at the measuring point(s) B1 to B5.

The base station 10, in particular the measuring device 10M, preferably has one or more sensors 10*y* to 10Z. In the embodiment shown, the base station 10, in particular the measuring device 10M, has a (first) sensor 10V for the (first) measuring point B1, a (further or second) sensor 10W for the second measuring point B2, a (further or third) sensor 10X for the third measuring point B3, a (further or fourth) sensor 10Y for the fourth measuring point B4 and/or a (further or fifth) sensor 10Z for the fifth measuring point B5.

The sensors 10V to 10Z are preferably one or more dust sensors to measure the particle number, particle size and/or particle concentration, one or more temperature sensors to measure the temperature and/or one or more humidity sensors to measure the humidity.

For example, the first sensor 10V and/or the second sensor 10W are/is designed as dust sensor(s), and/or the third sensor 10X, the fourth sensor 10Y and/or the fifth sensor 10Z are/is designed as temperature sensor(s) and/or humidity sensor(s).

The measuring device 10M, in particular the sensors 10V to 10Z, is/are preferably electrically connected to the control device 10S, the data processing device 10R and/or the communication device 10K, in particular to process and/or evaluate the measured values and/or to transmit the measured (or processed/evaluated) values to the cleaning device 20 and/or another device, such as a central unit or server.

The proposed method is preferably carried out by the proposed cleaning system 1 and/or the proposed base station 10. The following description refers again to the first cleaning device 20, but applies preferably also to the second cleaning device 30.

As already explained, before, during and/or after a cleaning process by means of the cleaning device 20 and/or before, during and/or after a maintenance process, in particular a suction process, by means of the base station 10, the room air RL is conditioned/climatized by means of the climate control device 60, in particular heated, cooled, humidified, dehumidified and/or cleaned, and preferably released to the surroundings as conditioned delivery air ZL.

The conditioning/climatization can in principle be carried out dependent or independent of maintenance and/or sucking out.

However, it is preferred that when using the cleaning device 20 and/or during a cleaning process, the room air RL is conditioned, in particular cleaned, by means of the base station 10, in particular the climate control device 60.

In an advantageous way, the dust whirled up by the cleaning device 20 can be at least partially collected by the base station 10. In addition, it is possible to cool the room air RL by means of the base station 10, in particular the climate control device 60, in such a way that the heat generated by the cleaning device 20 is at least partially dissipated in order to maintain or create a pleasant room climate.

It is also preferred that during a maintenance process, in particular a suction process, the climate control device 60 is activated and/or the room air RL is conditioned/climatized by means of the climate control device 60.

In a particularly preferred method variant, (also) during a maintenance process by means of the base station 10, the air sucked out of the cleaning device 20 is aftertreated/post-treated by means of the climate control device 60 and/or is fed into the climate control device 60 for aftertreatment/post-treatment, in particular via the connecting line 10T.

In this way, it is possible to clean, cool, heat, humidify and/or dehumidify the air passing through the container 50G and/or the filter 50H—in addition and/or before it is released to the surroundings. In this way, when a maintenance process and/or a suction process is carried out, the room climate is adjusted and/or negative effects caused by the operation of the base station 10, in particular the blower 50J, are directly at least partially compensated for.

It is preferred that during cleaning by means of the cleaning device 20, the room air RL for conditioning is sucked in via the inlet 60A of the climate control device 60.

When sucking out and/or during a suction process and/or when the cleaning device 20 is connected to the base station 10, preferably the air flow/air routing in the base station 10 is (automatically) changed and/or the valve(s) 10U and/or 60Z are/is actuated, in particular in such a way that the container 50G is pneumatically coupled to the climate control device 60 and/or the room air RL—in particular instead of being sucked in via the inlet 60A of the climate control device 60—is sucked in via the fluidic connection(s) 40F and/or 50F of the base station 10 and is supplied/fed to the climate control device 60.

In such a method variant, the air supply to the climate control device 60 is consequently changed when changing from a cleaning process by means of the cleaning device 20 to a suction process by means of the base station 10 (or vice versa), in particular without interruption and/or without deactivating the climate control device 60.

When using the cleaning device 20 and/or when carrying out a cleaning process, preferably the quality of the room air, in particular the particle concentration, the humidity and/or the temperature of the room air RL, is measured and/or determined by means of the cleaning device 20, in particular the measuring apparatus 20M, and/or by means of the base station 10, in particular the measuring device 10M.

Preferably, the conditioning/climatization is controlled by means of the base station 10 and/or the climate control device 60, in particular by means of the measuring device 10M, and/or by means of the cleaning device 20, in particular the measuring apparatus 20M, and/or depending on the detected or determined measured values. In particular, the conditioning/climatization is (automatically) started, stopped and/or adjusted depending on the detected or determined measured values.

For example, it is possible that if the dust concentration is too high and/or if a predefined limit value is exceeded, the room air RL is cleaned by means of the climate control device 60, in particular the filter arrangement 60C, if the temperature is too low and/or if it falls below a predefined temperature, the room air RL is heated by means of the climate control device 60, in particular the heater 60H, if the temperature is too high and/or if a predefined temperature is exceeded, the room air RL is cooled by means of the climate control device 60, in particular the cooler 60E, if the humidity is too low and/or if it falls below a predefined humidity, the room air RL is humidified by means of the climate control device 60, in particular the humidifier 60G, and/or if the humidity is too high and/or if the a predefined humidity is exceeded, the room air RL is dehumidified or dried by means of the climate control device 60, in particular the dehumidifier 60F, particularly preferably during the execution of a cleaning process by means of the cleaning device 20 and/or during the execution of a maintenance process by means of the base station 10.

Consequently, the measured values of the measuring apparatus 20M of the cleaning device 20 are used particularly preferably—also or exclusively—for controlling the climate control device 60. For this purpose, one or more measured values are transmitted between the cleaning device 20 and the base station 10 (in terms of a data connection).

By using the measuring apparatus 20M of the cleaning device 20 it is possible to measure the air quality at different locations in the room and/or at a distance from and/or independent of the base station 10.

The measured values of the cleaning device 20 can, for example, be used as averaged values to control the base station 10, in particular the climate control device 60, and/or can be compared with the measured values of the base station 10, in particular the measuring device 10M. In this way, any errors and/or (local) outliers can be identified, in particular to avoid overdriving of the climate control device 60.

Preferably, the cleaning system 1 and/or the base station 10 can be coupled (in terms of data connections) with the cleaning device 20 and/or further devices, such as a mobile device and/or a central unit.

Preferably, a wired or wireless data connection can be established between the base station 10 and the cleaning device 20 or a further device, in particular to transmit a signal and/or information or to exchange a signal and/or information between the base station 10 and the cleaning device 20 and/or a further device. The data exchange and/or signal transmission can be performed directly or indirectly, for example via a mobile device or a central unit.

A signal in the sense of the present invention is preferably a means of transmitting information, a (modulated) wave, in particular in a conductor, a sequence, a packet in the information technological sense or the like.

Preferably, a signal in the sense of the present invention is transmittable via a—wireless or wired—data connection. Particularly preferably, one or more pieces of information, for example concerning air quality, are assigned to a signal and/or contained in a signal.

In order to enable data exchange between the base station 10 and the cleaning device 20 and/or a further device and/or to transmit a signal, in particular the measured values, the base station 10 preferably has the communication device 10K and the cleaning device 20 the communication apparatus 20K.

The communication device 10K and/or the communication apparatus 20K preferably have/has (each) a receiver for receiving a signal, a transmitter for sending a signal and/or an interface, in particular a radio interface, a WPAN interface, a near field communication interface, an NFC interface, a WLAN interface or another, particularly preferably wireless interface.

Additionally or alternatively, the electrical connection(s) 40E and/or 50E of the base station 10 and the electrical connection(s) 20E and/or 30E of the cleaning device 20 are used for the preferably wired data exchange between the base station 10 and the cleaning device 20, in particular when the cleaning device 20 is in the connection position.

The transmission of the measured values is preferably carried out when the cleaning device 20 is connected to the base station 10 and/or is in use, i.e. when it is carrying out a cleaning process. In particular, it is possible for measured values to be transmitted continuously or at intervals between the base station 10 and the cleaning device 20.

By means of the proposed base station 10 and/or the proposed method, it is possible to maintain or improve the quality of the room air, in particular when carrying out a cleaning process and/or a maintenance process. In particular, it is possible to detect a high dust load and/or, depending on the measured air quality, to activate or deactivate the climate control device 60 and/or to adjust the conditioning/climatization by means of the base station 10.

Individual aspects, features, method steps and method variants of the present invention can be realized independently, but also in any combination and/or sequence.

REFERENCE CHARACTER LIST

| Reference character list: | |
|---|---|
| 1 | Cleaning System |
| 2 | Wall |
| 3 | Floor |
| 10 | Base Station |
| 10A | Power Supply Unit |
| 10B | Power Connection |
| 10C | Holder |
| 10D | Flap |
| 10E | Shut-Off Apparatus |
| 10G | Feed/Supply/Inlet Line |
| 10H | Blower/Fan Line |
| 10J | Outlet Line |
| 10K | Communication Device |
| 10L | Outlet Opening |
| 10M | Measuring Device |
| 10N | First Connection Line |
| 10P | Second Connection Line |
| 10R | Data Processing Device |
| 10S | Control Device |
| 10T | Connecting Line |
| 10U | Outlet Valve |
| 10V | First Sensor |
| 10W | Second Sensor |

-continued

| Reference character list: | |
|---|---|
| 10X | Third Sensor |
| 10Y | Fourth Sensor |
| 10Z | Fifth Sensor |
| 20 | First Cleaning Device |
| 20A | Accumulator |
| 20B | Intake/Suction Opening |
| 20C | Chamber |
| 20D | Intake/Suction Line |
| 20E | Electrical Connection |
| 20F | Fluidic Connection |
| 20G | Feed/Supply/Inlet Line |
| 20H | Connecting Line |
| 20J | Blower/Fan |
| 20K | Communication Apparatus |
| 20L | Outlet Line |
| 20M | Measuring Apparatus |
| 20N | Outlet Opening |
| 20P | Suction/Emptying Line |
| 20Q | Suction/Emptying Valve |
| 20R | Data Processing Apparatus |
| 20S | Control Apparatus |
| 20W | First Sensor |
| 20X | Second Sensor |
| 30 | Second Cleaning Device |
| 30A | Accumulator |
| 30C | Chamber |
| 30E | Electrical Connection |
| 40 | Bottom Module |
| 40A | Receving Space |
| 40B | Foot Part |
| 40E | Electrical Connection |
| 40F | Fluidic Connection |
| 50 | Head Module |
| 50A | Housing |
| 50C | Front Side |
| 50E | Electrical Connection |
| 50F | Fluidic Connection |
| 50G | Container |
| 50H | Filter |
| 50J | Blower/Fan |
| 60 | Climate Control Device/Air Conditioner |
| 60A | Inlet |
| 60B | Inlet Flap |
| 60C | Filter Arrangement |
| 60D | Preheater |
| 60E | Cooler |
| 60F | Dehumidifier |
| 60G | Humidifier |
| 60H | Heater |
| 60J | Blower/Fan |
| 60K | Outlet |
| 60L | Outlet Flap |
| 60M | Inlet Line |
| 60N | Pre-Filter |
| 60P | Suspended Matter Filter |
| 60Q | Activated Carbon Filter |
| 60R | Photocatalyst |
| 60S | Ozone Generator |
| 60T | Electric Filter |
| 60U | Exhaust Air Connection |
| 60V | Outside Air Connection |
| 60W | Tank |
| 60X | Pump |
| 60Y | Outlet Line |
| 60Z | Valve |
| B1 | First Measuring Point in the Base Station |
| B2 | Second Measuring Point in the Base Station |
| B3 | Third Measuring Point in the Base Station |
| B4 | Fourth Measuring Point in the Base Station |
| B5 | Fifth Measuring Point in the Base Station |
| S1 | First Measuring Point in the Ceaning Device |
| S2 | Second Measuring Point in the Cleaning Device |
| RL | Room Air/Ambient Air |
| ZL | Delivery/Conditioned/Fresh Air |

What is claimed is:

1. A method to operate a cleaning system with a cleaning device and a base station for the cleaning device, comprising:

measuring a quality of room air by at least one of the base station or the cleaning device, and conditioning the room air by the base station, wherein the conditioning is controlled depending on the measured quality of room air.

2. The method according to claim 1, wherein the room air is conditioned at least one of before, during or after at least one of a cleaning process by the cleaning device or a maintenance process by the base station.

3. The method according to claim 2, wherein the room air is at least one of heated, cooled, humidified, dehumidified or cleaned.

4. The method according to claim 1, wherein during a maintenance process by the base station, room air is sucked together with vacuumed material from the cleaning device into the base station and the vacuumed material is separated in a container of the base station, the room air subsequently being at least one of after treated or conditioned.

5. The method according to claim 1, wherein at least one of the particle concentration, the humidity or the temperature of the room air is measured by the base station.

6. The method according to claim 5, wherein the measuring by the base station is performed at least one of before, during or after at least one of a cleaning process by the cleaning device or a maintenance process by the base station.

7. The method according to claim 1, wherein the quality of the room air is measured by the base station and the cleaning device.

8. The method according to claim 7, wherein measured values of the base station are compared with the measured values of the cleaning device.

9. The method according to claim 1, wherein the measuring by the cleaning device is performed at least one of before, during or after at least one of a cleaning process by the cleaning device or a maintenance process by the base station.

10. The method according to claim 1, wherein, depending on the measured values, at least one of a cleaning process by the cleaning device or the conditioning by the base station is at least one of automatically started, ended or adapted.

11. The method according to claim 1, wherein the base station is equipped with at least one of a climate control device that conditions room air or a measuring device that measures the quality of the room air.

* * * * *